US007331203B2

(12) United States Patent
Lee

(10) Patent No.: US 7,331,203 B2
(45) Date of Patent: Feb. 19, 2008

(54) MERCHANDISE LOCK

(76) Inventor: Miko Lee, 3 Fl., No. 649-5, Chung Cheng Rd., Hsin Chuang City, Taipei Hsien (TW)

( * ) Notice: Subject to any disclaimer, the term of this patent is extended or adjusted under 35 U.S.C. 154(b) by 34 days.

(21) Appl. No.: 11/473,266

(22) Filed: Jun. 23, 2006

(65) Prior Publication Data

US 2007/0295040 A1 Dec. 27, 2007

(51) Int. Cl.
*E05B 73/00* (2006.01)

(52) U.S. Cl. ..... 70/14; 70/58; 70/491

(58) Field of Classification Search ..... 70/14, 70/18, 19, 49, 57, 58, 491, 496, 423, 424, 70/427–430; 248/551–553
See application file for complete search history.

(56) References Cited

U.S. PATENT DOCUMENTS

| | | | | |
|---|---|---|---|---|
| 1,000,962 | A | 8/1911 | Blais | |
| 1,921,434 | A | 8/1933 | Stone | |
| 3,631,896 | A | 1/1972 | Meigs | |
| 4,154,071 | A | 5/1979 | Castle | |
| 4,964,285 | A | 10/1990 | Lakoski et al. | |
| 4,970,883 | A | 11/1990 | Johnson | |
| 5,050,413 | A | 9/1991 | Stillwagon et al. | |
| 5,133,203 | A | 7/1992 | Huang et al. | |
| 5,197,314 | A | 3/1993 | Stillwagon et al. | |
| 5,289,704 | A | 3/1994 | Johnson | |
| 5,327,752 | A | 7/1994 | Myers et al. | |
| 5,381,685 | A | 1/1995 | Carl et al. | |
| 5,493,878 | A | 2/1996 | Murray, Jr. et al. | |
| 5,502,989 | A | 4/1996 | Murray, Jr. et al. | |
| 5,548,981 | A | 8/1996 | Kirk | |
| 5,622,064 | A | 4/1997 | Gluskoter et al. | |
| 5,687,592 | A | 11/1997 | Penniman et al. | |
| 5,692,400 | A | 12/1997 | Bliven et al. | |
| 5,709,110 | A | 1/1998 | Greenfield et al. | |
| 5,787,739 | A | 8/1998 | Derman | |
| 5,791,171 | A * | 8/1998 | Kelley | 70/58 |
| 5,829,280 | A | 11/1998 | Chen | |
| 5,836,183 | A | 11/1998 | Derman | |
| 5,868,014 | A | 2/1999 | Lee | |
| 5,875,657 | A * | 3/1999 | Kelley | 70/18 |
| 5,913,907 | A | 6/1999 | Lee | |
| 6,000,251 | A | 12/1999 | Murray, Jr. et al. | |

(Continued)

FOREIGN PATENT DOCUMENTS

| | | |
|---|---|---|
| WO | WO-93/15295 A1 | 8/1993 |

*Primary Examiner*—Lloyd A. Gall
(74) *Attorney, Agent, or Firm*—Birch, Stewart, Kolasch & Birch, LLP

(57) ABSTRACT

A merchandise lock has a shell, an external sleeve, an internal sleeve, at least one stationary locking sheet and a movable locking sheet. The external sleeve is mounted on an end of the shell. The internal sleeve is mounted in the shell and the external sleeve. The stationary locking sheet is mounted in the internal sleeve and has a locking recess and a tongue extending out of the internal sleeve. The movable locking sheet is mounted pivotally in the internal sleeve and has a locking recess and a tongue extending out of the internal sleeve. When the lock cylinder is locked, the locking recesses align with each other and the tongues misalign with each other. When the lock cylinder is unlocked, the locking recesses misalign with each other and the tongues align with each other.

9 Claims, 6 Drawing Sheets

U.S. PATENT DOCUMENTS 6,000,252 A 12/1999 Murray, Jr. et al.
6,006,557 A 12/1999 Carl et al.
6,038,891 A 3/2000 Zeren et al.
6,058,744 A 5/2000 Ling
6,112,561 A 9/2000 Carl
6,122,562 A 9/2000 Kinney et al.
6,155,088 A 12/2000 Murray, Jr. et al.
6,173,591 B1 1/2001 Derman
6,199,413 B1 3/2001 McDaid et al.
6,205,824 B1 3/2001 Miao
6,224,080 B1 5/2001 Ross
6,224,082 B1 5/2001 Landoll et al.
6,227,016 B1 5/2001 Yu
6,227,017 B1 5/2001 Igelmund
6,257,029 B1 * 7/2001 Liao ..... 70/58
6,295,847 B1 10/2001 Zeren
6,301,940 B1 10/2001 Derman et al.
6,305,197 B1 10/2001 Ling
6,321,579 B1 * 11/2001 Reyes ..... 70/58
6,401,502 B1 * 6/2002 Yang ..... 70/30
6,449,992 B1 * 9/2002 Yu et al. ..... 70/58
6,463,770 B1 10/2002 Lee
6,513,350 B1 2/2003 Hurd et al.
6,523,373 B1 * 2/2003 Su ..... 70/58
6,553,794 B1 4/2003 Murray, Jr. et al.
6,588,241 B1 7/2003 Murray, Jr. et al.
6,591,642 B1 7/2003 Kuo
6,619,080 B1 * 9/2003 Yu ..... 70/58
6,619,081 B1 * 9/2003 Yu ..... 70/58
6,662,602 B1 12/2003 Carl
6,672,117 B2 * 1/2004 Yu ..... 70/58
6,735,990 B1 5/2004 Murray, Jr. et al.
6,758,069 B2 7/2004 Derman
6,880,373 B2 * 4/2005 Ling ..... 70/58
6,886,376 B2 5/2005 Kuo
6,918,272 B1 * 7/2005 Sanders ..... 70/58
6,968,716 B1 * 11/2005 Ling ..... 70/14
7,073,358 B1 * 7/2006 Lee ..... 70/58
7,234,326 B1 * 6/2007 Lu et al. ..... 70/58
2003/0106349 A1 * 6/2003 Braodbridge et al. ..... 70/58
2003/0213274 A1 * 11/2003 Mazzarello ..... 70/428
2007/0169523 A1 * 7/2007 Lu ..... 70/58

* cited by examiner

MERCHANDISE LOCK

BACKGROUND OF THE INVENTION

1. Field of the Invention

The present invention relates to a merchandise lock, especially to a merchandise lock that attaches an electrical appliance to a specific place.

2. Description of the Prior Arts

Open-shelf malls have become more and more common recently. Electrical appliances such as televisions, refrigerators, computers, cell phones, digital cameras, etc. are often displayed at the open-shelf malls to sell. However, security at open-shelf malls is often lax, and merchandise is subject to shoplifting. If the malls do not have sufficient sales personnel or proper security systems to monitor the electrical appliances, the electrical appliances are easily stolen, especially small and expensive electrical appliances such as digital cameras and portable video games. Therefore, the electrical appliances are not safe to sell in open-shelf malls.

To overcome the shortcomings, the present invention provides a merchandise lock to mitigate or obviate the aforementioned problems.

SUMMARY OF THE INVENTION

The main objective of the present invention is to provide a merchandise lock to connect an electrical appliance to a cable that is fastened at a specific place. The merchandise lock has a shell, an external sleeve, an internal sleeve, at least one stationary locking sheet and a movable locking sheet. The external sleeve is mounted on an end of the shell. The internal sleeve is mounted in the shell and the external sleeve. The stationary locking sheet is mounted in the internal sleeve and has a locking recess and a tongue extending out of the internal sleeve. The movable locking sheet is mounted pivotally in the internal sleeve and has a locking recess and a tongue extending out of the internal sleeve. When the lock cylinder is locked, the locking recesses align with each other and the tongues misalign with each other. When the lock cylinder is unlocked, the locking recesses misalign with each other and the tongues align with each other.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
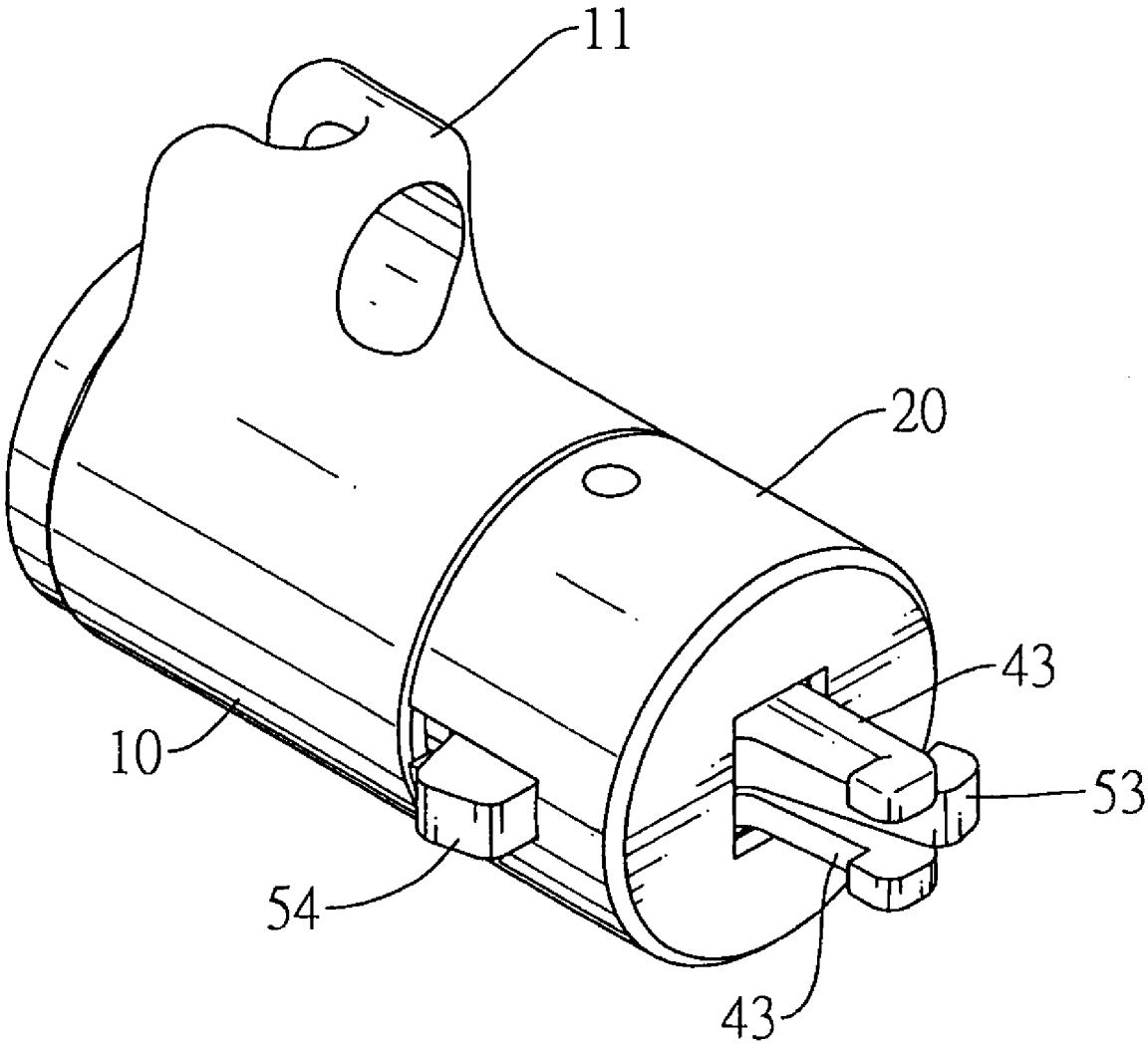
FIG. 1 is a perspective view of a merchandise lock in accordance with the present invention.
Figure 2:
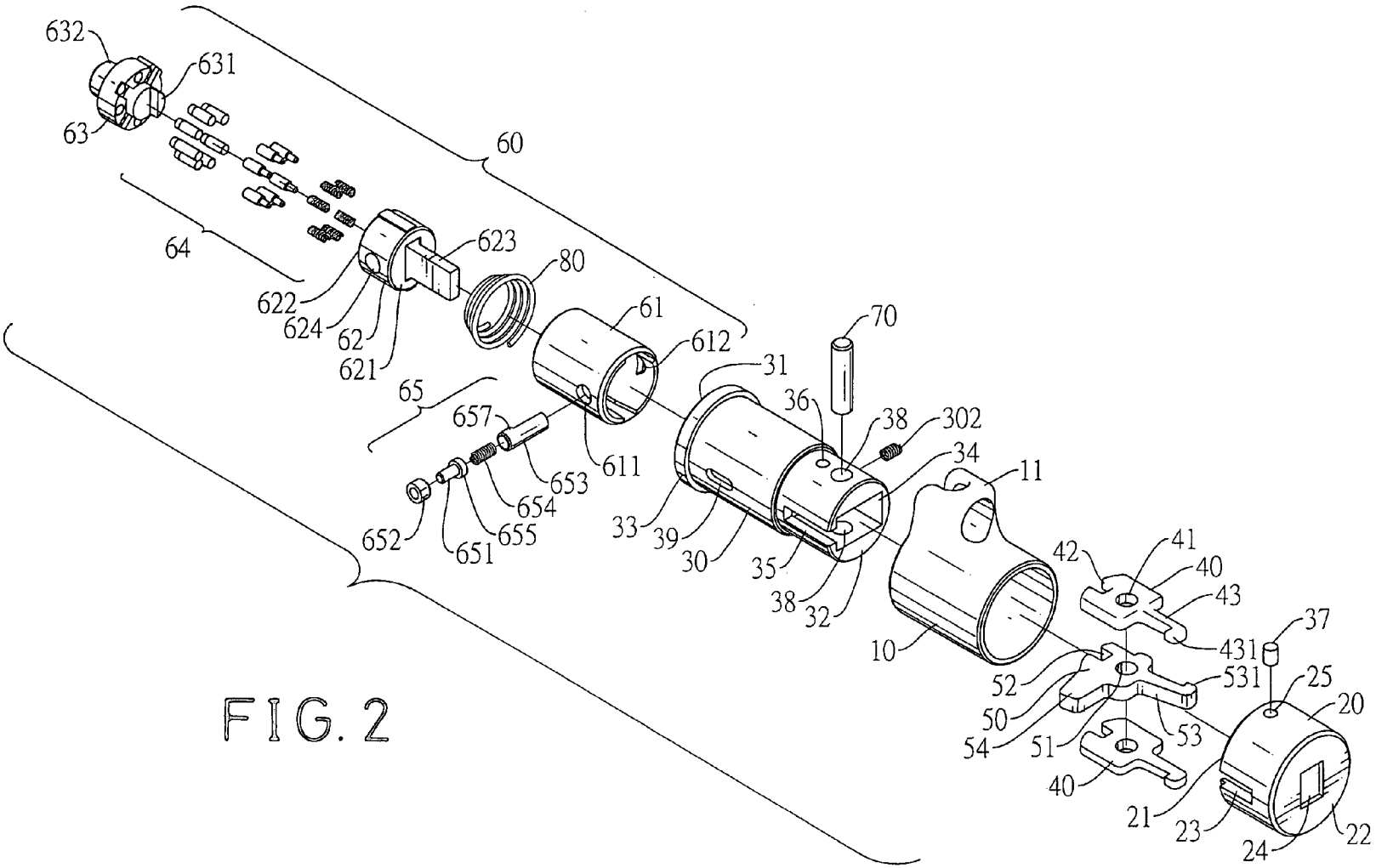
FIG. 2 is an exploded perspective view of the merchandise lock in FIG. 1.
Figure 3:
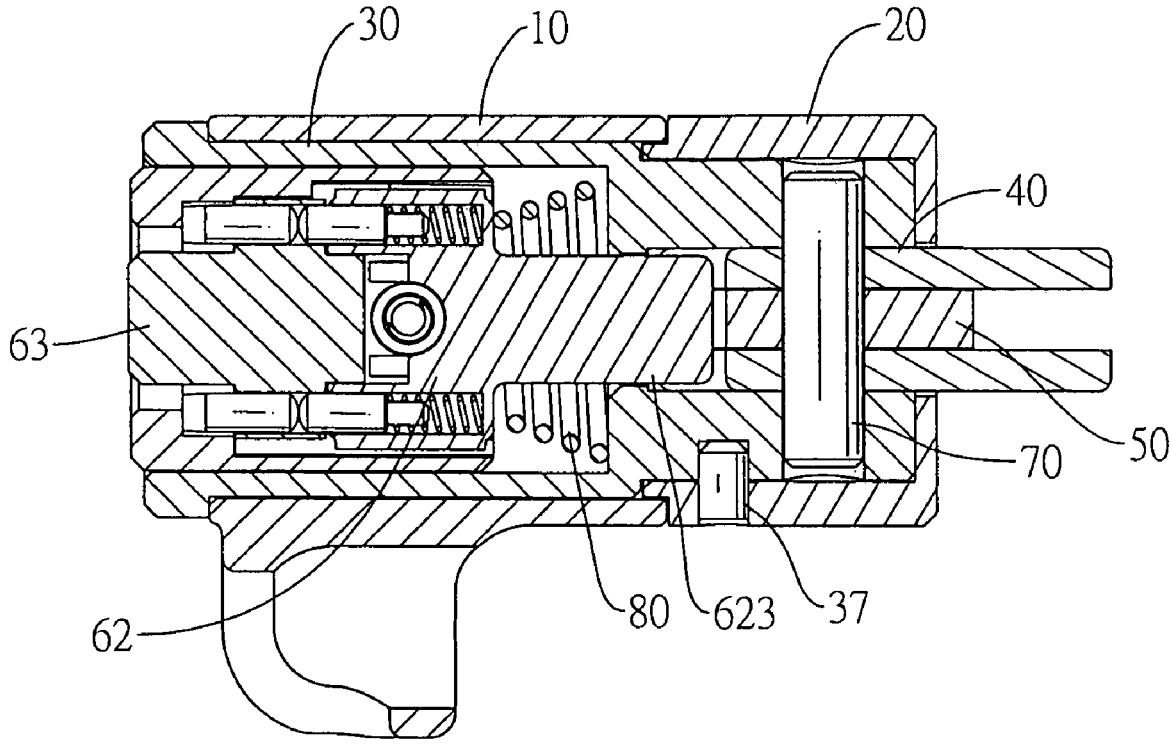
FIG. 3 is an operational side view in partial section of the merchandise lock in FIG. 1 when the merchandise lock is locked.
Figure 4:
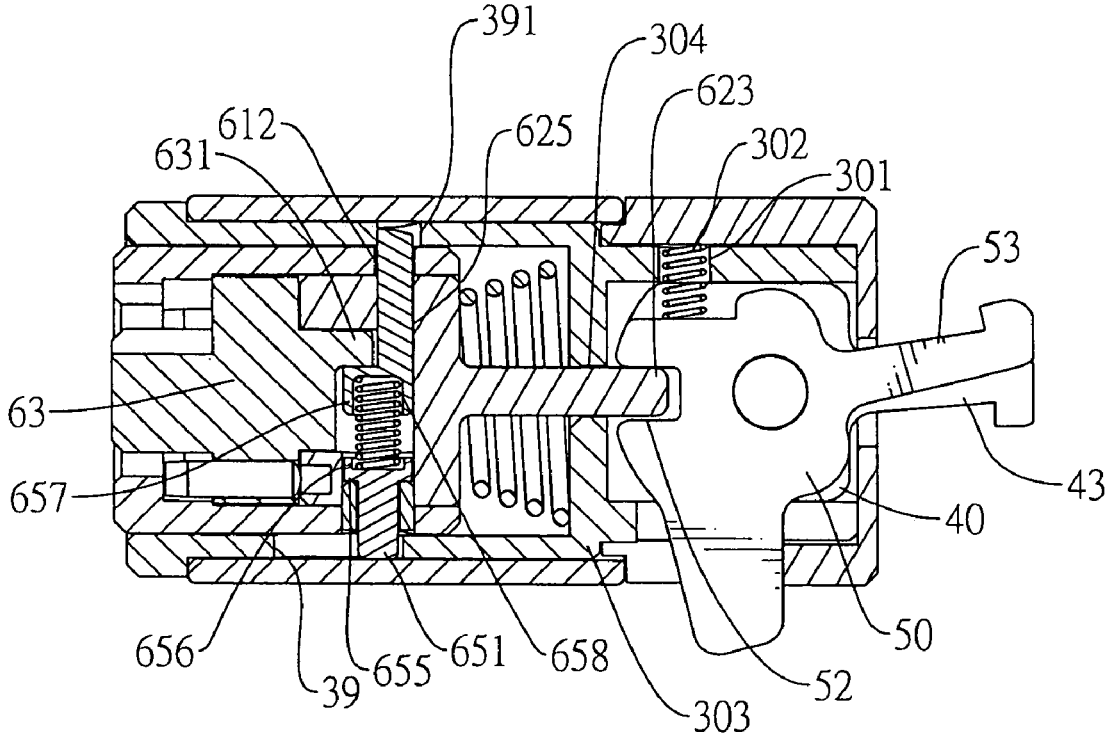
FIG. 4 is an operational top view in partial section of the merchandise lock in FIG. 1 when the merchandise lock is locked.

With reference to FIGS. 1 to 4, a merchandise lock in accordance with the present invention comprises a shell (10), an external sleeve (20), an internal sleeve (30), at least one stationary locking sheet (40), a movable locking sheet (50), a lock cylinder (60), an optional shaft (70) and a second spring (80).

The shell (10) is hollow and has a front end, a rear end, an outer wall and an optional connecting part (11). The connecting part (11) is formed radially on the outer wall of the shell (10) to connect to a cable.

The external sleeve (20) is hollow, is mounted on the front end of the shell (10) and has a sidewall, a rear end (21), a front end (22), a notch (23), a through hole (24) and an optional fastening hole (25). The rear end (21) may be an opening end and the front end (22) may be a closed end. The notch (23) is formed through the sidewall of the external sleeve (20) adjacent to the rear end (21) of the external sleeve (20). The through hole (24) is formed through the front end (22) of the external sleeve (20). The fastening hole (25) is formed through the sidewall of the external sleeve (20).

The internal sleeve (30) is mounted in the shell (10), is mounted securely in the external sleeve (20), has a sidewall, a rear end (31), a front end (32), a mounting recess (34), a notch (35), an optional receiving hole (301) and a first spring (302) and may have an annular flange (33), a fastening hole (36), a fastening pin (37), two pivoting holes (38), a slot (39), a mounting hole (391) and a partition (303). The rear end (31) of the internal sleeve (30) may be an opening end and the front end (32) of the internal sleeve (30) may be a closed end. The mounting recess (34) is formed axially in the front end (32) of the internal sleeve (30). The notch (35) is formed through the sidewall of the internal sleeve (30), communicates with the mounted recess (34) of the internal sleeve (30) and corresponds to the notch (23) of the external sleeve (20). The receiving hole (301) is formed through the side wall of the internal sleeve (30) and communicates with the mounted recess (34) in the internal sleeve (30). The first spring (302) is mounted in the sidewall of the internal sleeve (30), extends into the mounted recess (34) in the internal sleeve (30) and may be mounted in the receiving hole (301) of the internal sleeve (30). The annular flange (33) is formed around the rear end (31) of the internal sleeve (30) and abuts the shell (10) to keep the internal sleeve (30) from axially separating out of the shell (10). The fastening hole (36) is formed in sidewall of the internal sleeve (30) and aligns with the fastening hole (25) in the external sleeve (20). The fastening pin (37) extends through the fastening holes (25, 36) in the external and internal sleeves (20, 30) to fasten the internal sleeve (30) in the external sleeve (20). The pivoting holes (38) are formed through the sidewall of the internal sleeve (30), align to each other and communicate with the mounted recess (34) in the internal sleeve (30). The slot (39) is formed through the sidewall of the internal sleeve (30) near the rear end (31) of the internal sleeve (30). The mounting hole (391) is formed through sidewall of the internal sleeve (30) and is opposite to the slot (39). The partition (303) is formed radially in the internal sleeve (30) between the notch (35) and the slot (39) and has a central hole (304).

Each stationary locking sheet (40) is mounted in the mounting recess (34) in the internal sleeve (30), extends out of the external sleeve (20), has a front end, a rear end, a locking recess (42) and a stationary tongue (43) and may have a pivoting hole (41). The locking recess (42) is formed in the rear end of the stationary locking sheet (40) and may correspond to the central hole (304) of the partition (303) in the internal sleeve (30). The stationary tongue (43) is formed on the front end of the stationary locking sheet (40), extends out of the through hole (24) in the external sleeve (20) and has a distal end and a protrusion (431). The protrusion (431) is formed on the distal end of the stationary tongue (43). The pivoting hole (41) is formed through the stationary locking sheet (40) and aligns with the pivoting holes (38) of the internal sleeve (30).

The movable locking sheet (50) is mounted pivotally in the mounting recess (34), is pushed by the first spring (302), extends out of the external sleeve (20), has a front end, a rear end, a side edge, a locking recess (52), a movable tongue (53) and a stem (54) and may have a pivoting hole (51). The locking recess (52) is formed in the rear end of the movable locking sheet (50) and selectively aligns with the locking recess (42) of the stationary locking sheet (40). The movable tongue (53) is formed on the front end of the movable locking sheet (50), extends out of the through hole (24) in the external sleeve (20), selectively aligns with the stationary tongue (43) of the stationary locking sheet (40) and has a distal end and a protrusion (531). The protrusion (531) is formed on the distal end of the movable tongue (53). When the locking recess (52) of the movable locking sheet (50) aligns with the locking recess (42) of the stationary locking sheet (40), the movable tongue (53) misaligns with the stationary tongue (43). When the movable tongue (53) aligns with the stationary tongue (43), the locking recess (52) of the movable locking sheet (50) misaligns with the locking recess (42) of the stationary locking sheet (40). The stem (54) is formed transversely on the side edge of the movable locking sheet (50), extends through the notch (35) in the internal sleeve (30) and extends out of the notch (23) of the external sleeve (20). The pivoting hole (51) is formed through the movable locking sheet (50) and aligns with the pivoting holes (41, 38) of the stationary locking sheet (40) and the internal sleeve (30). The movable locking sheet (50) may be mounted between two stationary locking sheets (40).

The lock cylinder (60) is mounted in the internal sleeve (30) and has an extension rod (623). The extension rod (623) extends out of the lock cylinder (60), may extend through the central hole (304) of the partition (303) and selectively engages the locking recesses (42, 52) of the stationary and movable locking sheets (40, 50). When the lock cylinder (60) is locked, the extension rod (623) engages with the locking recesses (42, 52) of the stationary and movable locking sheets (40, 50). When the lock cylinder (60) is unlocked, the extension rod (623) disengages from the locking recesses (42, 52) of the stationary and movable locking sheets (40, 50). The lock cylinder (60) may comprise a housing (61), a stationary segment (62), a rotatable segment (63), a locking pin assembly (64) and a lock actuating assembly (65).

The housing (61) is mounted in the internal sleeve (30) and has a sidewall, a through hole (611) and a passing hole (612). The through hole (611) is formed through the sidewall of the housing (61) and corresponds to and align with the slot (39) in the internal sleeve (30). The passing hole (612) is formed through the sidewall of the housing (61) and corresponds to and aligns with the mounting hole (391) in the internal sleeve (30).

The stationary segment (62) is tubular, is mounted in the housing (61) and has a front end, a rear end, a sidewall, a through hole (624) and a passing hole (625). The front end may be a closed end (621). The rear end may be an opening end (622). The extension rod (623) of the lock cylinder (60) is formed longitudinally on the front end of the stationary segment (62). The through hole (624) is formed through the sidewall of the stationary segment (62) and corresponds to and aligns with the through hole (611) in the housing (61). The passing hole (625) is formed through the sidewall of the stationary segment (62) and corresponds to and aligns with the passing hole (612) in the housing (61).

The rotatable segment (63) is mounted in the housing (61) and has a front end, a rear end, an active turning protrusion (631) and a central post (632). The active turning protrusion (631) is semicircular, is formed on the front end of the rotatable segment (63) and extends into the stationary segment (62). The central post (632) is formed on the rear end of the rotatable segment (63).

The locking pin assembly (64) is mounted in the stationary and rotatable segments (62, 63). When the locking pin assembly (64) is locked, the rotatable segment (63) is restricted to be not rotatable with respect to the stationary segment (62). When the locking pin assembly (64) is unlocked, the rotatable segment (63) is allowed to be rotatable with respect to the stationary segment (62).

The lock actuating assembly (65) is mounted in the stationary segment (62) of the lock cylinder (60) and has a guide rod (651), an actuating rod (653), a stop spring (654) and a bearing (652).

The guide rod (651) is mounted in the stationary segment (62) of the lock cylinder (60) and has an outer end, an inner end, a head (655) and a receiving recess (656). The outer end of the guide rod (651) extends through the through holes (624, 611) of the stationary segment (62) and the housing (61) and extends into the slot (39) in the internal sleeve (30). The head (655) is formed on the inner end of the guide rod (651). The receiving recess (656) is formed in the inner end of the guide rod (651).

The actuating rod (653) is mounted movably in the stationary segment (62) of the lock cylinder (60) and has an outer end, an inner end, an inactive turning protrusion (657) and a receiving recess (658). The outer end extends through the passing holes (625, 612) of the stationary segment (62) and the housing (61) and selectively extends into the passing hole (391) of the internal sleeve (30). The inactive turning protrusion (657) is formed on the inner end of the actuating rod (653) and abuts the active turning protrusion (631) of the rotatable segment (63) of the lock cylinder (60). The receiving recess (658) is formed in the inner end of the actuating rod (653) and corresponds to the receiving recess (656) of the guide rod (651).

The stop spring (654) is mounted respectively in the receiving recesses (656, 658) of the guide rod (651) and the actuating rod (653) and is attached respectively to the inner ends of the guide rod (651) and the actuating rod (653).

The bearing (652) is mounted in the through hole (611) of the housing (61) and is mounted around the guide rod (651) to abut the head (655) of the guide rod (651) to keep the guide rod (651) from escaping the through hole (611) of the housing (61).

The shaft (70) extends through the pivoting holes (38, 41, 51) of the internal sleeve (30), the stationary locking sheet (40) and the movable locking sheet (50) to mount the movable locking sheet (50) pivotally in the internal sleeve (30).

The second spring (80) is mounted in the internal sleeve (30), is mounted between the front end of the stationary segment (62) of the lock cylinder (60) and the internal sleeve (30) and is mounted around the extension rod (623) on the stationary segment (62).

The merchandise lock as described is used to connect an electrical appliance to a cable that is fastened at a specific place. Therefore, the electrical appliance is safe to sell in open-shelf malls. The first spring (302) pushes the movable locking sheet (50) to make the locking recess (52) of the movable locking sheet (50) align with the locking recess (42) of the stationary locking sheet (40). When the lock cylinder (60) is locked, the extension rod (623) engages with the locking recesses (42, 52) of the locking sheets (40, 50). Then the movable locking sheet (50) cannot be pivoted so the movable tongue (53) misaligns with the stationary tongue (43). Therefore, the tongues (43, 53) of the locking sheets (40, 50) cannot be inserted into or pull out of a fastening hole of the electrical appliance.

Figure 5:
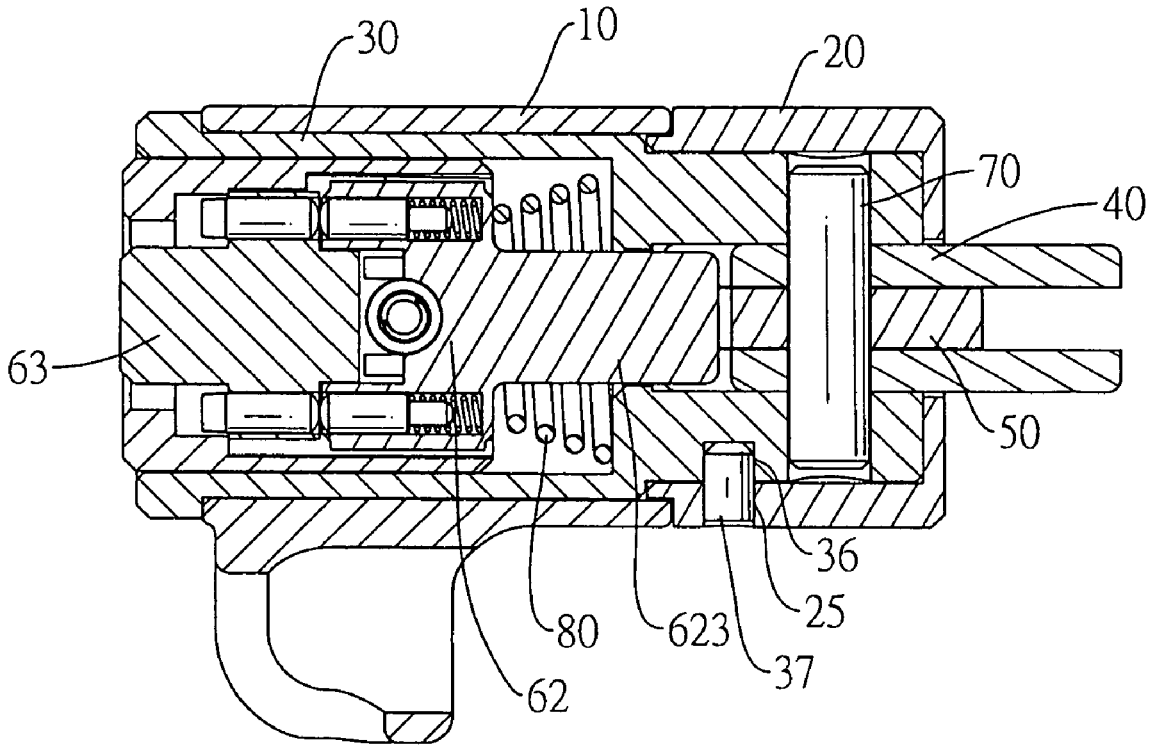
FIG. 5 is an operational side view in partial section of the merchandise lock in FIG. 1 when the merchandise lock is unlocking.
Figure 6:
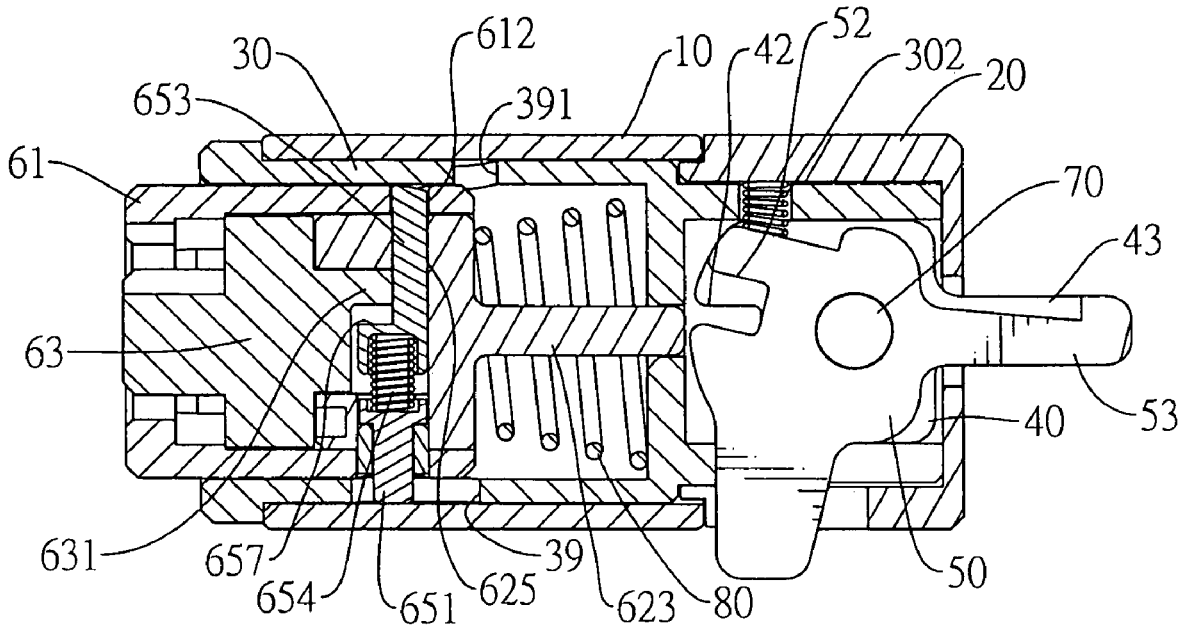
FIG. 6 is an operational top view in partial section of the merchandise lock in FIG. 1 when the merchandise lock is unlocked.

With further reference to FIG. 5, a proper key is inserting into the lock cylinder (60) to unlock the lock cylinder (60). The key rotates the rotatable segment (63) relative to the stationary segment (62) to rotate the active turning protrusion (631). The active turning protrusion (631) pushes the inactive turning protrusion (657) to retract into the lock cylinder (60). The second spring (80) can push the lock cylinder (60) to extend out of the rear end (31) of the internal sleeve (30). Then the extension rod (623) disengages the locking recesses (42, 52) of the locking sheets (40, 50). Therefore, the user can push the stem (54) to pivot the movable locking sheet (50) to make the tongues (42, 52) of the locking sheets (40, 50) align with each other. Then the tongues (42, 52) of the locking sheets (40, 50) can be inserted into or pull out of a fastening hole of the electrical appliance.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

The invention claimed is:

1. A merchandise lock comprising:

a hollow shell;

a hollow external sleeve mounted on the shell and having a notch formed through the sidewall of the external sleeve; and a through hole formed through the external sleeve;

an internal sleeve mounted in the shell, mounted securely in the external sleeve and having a mounting recess formed axially in the internal sleeve;

a notch formed through the internal sleeve communicating with the mounting recess of the internal sleeve and corresponding to the notch of the external sleeve; and a first spring mounted in the internal sleeve and extending into the mounting recess in the internal sleeve;

at least one stationary locking sheet mounted in the mounting recess in the internal sleeve, extending out of the external sleeve, and each one of the at least one stationary locking sheet having a locking recess formed in the stationary locking sheet; and a stationary tongue formed on the stationary locking sheet, extending out of the through hole in the external sleeve and having a protrusion formed on the stationary tongue;

a movable locking sheet mounted pivotally in the mounting recess, pushed by the first spring, extending out of the external sleeve and having a locking recess formed in the movable locking sheet and selectively aligning with the locking recess in the at least one stationary locking sheet;

a movable tongue formed on the movable locking sheet, extending out of the through hole in the external sleeve, selectively aligning with the stationary tongue of the at least one stationary locking sheet and having a protrusion formed on the movable tongue; and a stem formed transversely on a side edge of the movable locking sheet, extending through the notch in the internal sleeve and extending out of the notch of the external sleeve;

a lock cylinder mounted in the internal sleeve and having an extension rod extending out of the lock cylinder and selectively engaging with the locking recesses of the movable and at least one stationary locking sheets; and a second spring mounted in the internal sleeve and mounted around the extension rod on a stationary segment, wherein when the locking recess of the movable locking sheet aligns with the locking recess in the at least one stationary locking sheet, the movable tongue misaligns with the stationary tongue on the at least one stationary locking sheet;

when the movable tongue aligns with the stationary tongue on the at least one stationary locking sheet, the locking recess of the movable locking sheet misaligns with the locking recess in the at least one stationary locking sheet;

when the lock cylinder is locked, the extension rod engages with the locking recesses of the at least one stationary and movable locking sheets; and when the lock cylinder is unlocked, the extension rod disengages from the locking recesses of the at least one stationary and movable locking sheets.

2. The merchandise lock as claimed in claim 1, wherein the hollow shell having a front end, a rear end and an outer wall;

the hollow external sleeve having a sidewall;

a rear end;

a front end;

the notch of the external sleeve formed through the sidewall of the external sleeve adjacent to the rear end of the external sleeve; and the through hole of the external sleeve formed through the front end of the external sleeve;

the internal sleeve having a sidewall;

a rear end;

a front end;

the mounting recess of the internal sleeve formed axially in the front end of the internal sleeve;

the notch of the internal sleeve formed through the sidewall of the internal sleeve; and the first spring of the internal sleeve mounted in the sidewall of the internal sleeve;

each one of the at least one stationary locking sheet having a front end;

a rear end;

the locking recess of the stationary locking sheet formed in the rear end of the stationary locking sheet; and the stationary tongue of the stationary locking sheet formed on the front end of the stationary locking sheet and having a distal end; and the protrusion of the stationary tongue formed on the distal end of the stationary tongue; and the movable locking sheet having a front end;

a rear end;

a side edge;

the locking recess of the movable locking sheet formed in the rear end of the movable locking sheet;

the movable tongue of the movable locking sheet formed on the front end of the movable locking sheet and having a distal end; and the protrusion of the movable tongue formed on the distal end of the movable tongue; and the stem of the movable locking sheet formed transversely on the side edge of the movable locking sheet.

3. The merchandise lock as claimed in claim 2 comprising two stationary locking sheets, wherein the movable locking sheet is mounted between the stationary locking sheets.

4. The merchandise lock as claimed in claim 2, wherein the internal sleeve has two pivoting holes formed through the sidewall of the internal sleeve, aligning to each other and communicating with the mounting recess in the internal sleeve;

each one of the at least one stationary locking sheet has a pivoting hole formed through the stationary locking sheet and aligning with the pivoting holes of the internal sleeve;

the movable locking sheet has a pivoting hole formed through the movable locking sheet and aligning with the pivoting holes in the at least one stationary locking sheet and the internal sleeve; and the merchandise lock further comprises a shaft extending through the pivoting holes of the internal sleeve, the at least one stationary locking sheet and the movable locking sheet.

5. The merchandise lock as claimed in claim 2, wherein the external sleeve has a fastening hole formed through the sidewall of the external sleeve; and the internal sleeve has a fastening hole formed through the sidewall of the internal sleeve and aligning with the fastening hole in the external sleeve; and a fastening pin extending through the fastening holes in the external and internal sleeves.

6. The merchandise lock as claimed in claim 4, wherein the external sleeve has a fastening hole formed through the sidewall of the external sleeve; and the internal sleeve has a fastening hole formed through the sidewall of the internal sleeve and aligning with the fastening hole in the external sleeve; and a fastening pin extending through the fastening holes in the external and internal sleeves.

7. The merchandise lock as claimed in claim 2, wherein the internal sleeve has a receiving hole formed through the sidewall of the internal sleeve and communicating with the mounting recess in the internal sleeve; and the first spring of the internal sleeve is mounted in the receiving hole of the internal sleeve.

8. The merchandise lock as claimed in claim 6, wherein the internal sleeve has a receiving hole formed through the sidewall of the internal sleeve and communicating with the mounting recess in the internal sleeve; and the first spring of the internal sleeve is mounted in the receiving hole of the internal sleeve.

9. The merchandise lock as claimed in claim 2, wherein the internal sleeve has a slot formed through the sidewall of the internal sleeve near the rear end of the internal sleeve;

a mounting hole formed through sidewall of the internal sleeve opposite to the slot; and a partition formed radially in the internal sleeve between the notch and the slot and having a central hole; and the lock cylinder comprises a housing mounted in the internal sleeve and having a sidewall;

a through hole formed through the sidewall of the housing and corresponding to and aligning with the slot in the internal sleeve; and a passing hole formed through the sidewall of the housing and corresponding to and aligning with the mounting hole in the internal sleeve;

a tubular stationary segment mounted in the housing and having a front end, wherein the extension rod of the lock cylinder is formed longitudinally on the front end of the stationary segment;

a rear end;

a sidewall;

a through hole formed through the sidewall of the stationary segment and corresponding to and aligning with the through hole in the housing; and a passing hole formed through the sidewall of the stationary segment and corresponding to and aligning with the passing hole in the housing;

a rotatable segment mounted in the housing and having a front end;

a rear end;

a semicircular active turning protrusion formed on the front end of the rotatable segment and extending into the stationary segment; and a central post formed on the rear end of the rotatable segment;

a locking pin assembly mounted in the stationary and rotatable segments, wherein when the locking pin assembly is locked, the rotatable segment is restricted to be not rotatable with respect to the stationary segment, and when the locking pin assembly is unlocked, the rotatable segment is allowed to be rotatable with respect to the stationary segment; and a lock actuating assembly mounted in the stationary segment of the lock cylinder and having a guide rod mounted in the stationary segment of the lock cylinder and having an outer end extending through the through holes of the stationary segment and the housing and extending into the slot in the internal sleeve;

an inner end;

a head formed on the inner end of the guide rod; and a receiving recess formed in the inner end of the guide rod;

an actuating rod mounted movably in the stationary segment of the lock cylinder and having an outer end extending through the passing holes of the stationary segment and the housing and selectively extending into the mounting hole of the internal sleeve;

an inner end;

an inactive turning protrusion formed on the inner end of the actuating rod and abutting the active turning protrusion of the rotatable segment of the lock cylinder; and a receiving recess formed in the inner end of the actuating rod and corresponding to the receiving recess of the guide rod;

a stop spring mounted respectively in the receiving recesses of the guide rod and the actuating rod and attached respectively to the inner ends of the guide rod and the actuating rod; and a bearing mounted in the through hole of the housing and mounted around the guide rod to abut the head of the guide rod.

* * * * *